US006908084B2

(12) United States Patent
Jackson

(10) Patent No.: US 6,908,084 B2
(45) Date of Patent: Jun. 21, 2005

(54) GAMING APPARATUS WITH NEW SYMBOL DETERMINANT SYSTEM

(76) Inventor: Kathleen Nylund Jackson, 51 Williamsburg La., Scituate, MA (US) 02066

( * ) Notice: Subject to any disclaimer, the term of this patent is extended or adjusted under 35 U.S.C. 154(b) by 0 days.

(21) Appl. No.: 10/642,354

(22) Filed: Aug. 15, 2003

(65) Prior Publication Data

US 2005/0035550 A1 Feb. 17, 2005

(51) Int. Cl.[7] ..... G07F 17/34
(52) U.S. Cl. ..... 273/138.2; 273/143 R; 273/121 B; 463/20
(58) Field of Search ..... 273/138.2, 138.1, 273/143 R, 121 B; 463/20

(56) References Cited

U.S. PATENT DOCUMENTS

| | | | | |
|---|---|---|---|---|
| 5,016,879 A | | 5/1991 | Parker et al. | 273/126 A |
| 5,882,261 A | | 3/1999 | Adams | 463/20 |
| 5,890,962 A | | 4/1999 | Takemoto | 463/20 |
| 5,904,352 A | | 5/1999 | Takemoto | 273/121 B |
| 6,047,963 A | | 4/2000 | Pierce et al. | 273/121 B |
| 6,139,016 A | | 10/2000 | Plato | 273/121 B |
| 6,203,008 B1 | | 3/2001 | Krise et al. | 273/121 B |
| 6,203,009 B1 | | 3/2001 | Sines et al. | 273/121 B |
| 6,220,593 B1 | | 4/2001 | Pierce et al. | 273/138.1 |
| 6,251,013 B1 | * | 6/2001 | Bennett | 463/13 |
| 6,311,976 B1 | | 11/2001 | Yoseloff et al. | 273/138.2 |
| 6,340,158 B2 | | 1/2002 | Pierce et al. | 273/138.1 |
| 6,398,219 B1 | | 6/2002 | Pierce et al. | 273/138.2 |
| 6,419,225 B2 | | 7/2002 | Sines et al. | 273/121 B |
| 6,419,579 B1 | * | 7/2002 | Bennett | 463/20 |
| 6,554,704 B2 | * | 4/2003 | Nicastro et al. | 463/20 |

* cited by examiner

*Primary Examiner*—Benjamin Layno
(74) *Attorney, Agent, or Firm*—Mark A. Litman & Associates, P.A.

(57) ABSTRACT

A gaming apparatus provides symbols to determine winning outcomes. An object-element passes in a path through displayed pathways on a display. As the object-element passes over symbol collecting positions on the display in the pathways, symbols on collecting positions are activated as part of a game display. The gaming apparatus provides at least one award for predetermined combinations of symbols. The object-element should collect at least two symbols in a single pass through the path.

25 Claims, 11 Drawing Sheets

GAMING APPARATUS WITH NEW SYMBOL DETERMINANT SYSTEM

BACKGROUND OF THE INVENTION

1. Field of the Invention

The invention relates to the field of gaming, particularly the field of slot-type gaming in which symbols are randomly provided to determine winning and losing outcomes, and most particularly to gaming apparatus with a video format.

2. Background of the Art

Slot machines have been a dominant part of the gaming industry worldwide for over 50 years. While pachinko machines have seen a great deal of popularity in Asia, they are not as well suited for gaming as the traditional slot machine and have not found great commercial success in the United States, South America and Europe.

Slot machines have basically changed little over the years. Whether mechanical or electronic, they still display reels spinning and coming to stop on symbols which, in predetermined combinations, can award winnings or even a potential jackpot. It appears that a large part of the appeal of slot machines is the "mechanical" nature of the spinning reels which induces a belief in players that they are witnesses to a truly random event and that the big jackpot is only a matter of time and statistical fortune, where enough time at a machine will eventually provide a jackpot. While the big jackpot may or may not occur soon after a player engages a machine, slot machines maintain a very accurate payout percentage, usually 92 to 99 percent, with the house retaining the rest as income.

The public perception and reaction to slot machines is a critical part of their acceptance and the perception of the fairness of the machine. When slot machines with video displays showing simulated reels were introduced, the public initially rejected them in favor of the older slot machines with mechanical reels. Even though the new machines simulated the mechanical slots in every way and used the same random number generating circuit and yielded the same percentages as the mechanical slot machines, they were less attractive to the gaming public.

There have been a number of attempts to blend the look and play of pachinko-type games into slot machine play. Many of the attempts have been provided in distinct game play or bonus event play, such as described in U.S. Pat. Nos. 6,398,219; 6,340,158; 6,311,976; 6,220,593; 6,203,009; 6,203,008; 6,139,013; 6,047,963; 5,882,261; and 5,890,962. Other machines have attempted to use the pachinko-style of ball drop play to select symbols for reels.

U.S. Pat. No. 5,016,879 shows a pachinko-style system where there are three distinct ball drop areas. When a ball in each area drops into a resting slot at the bottom of the ball drop area, a specific symbol is provided that is displayed on a reel that is unique to that ball drop area.

U.S. Pat. No. 5,904,352 describes a pachinko game machine having a card game playing function, to play a game enjoying the atmosphere of playing a card game. When a pachinko ball drops into the specific winning section, the card symbol display section displays on the five display positions five symbols out of the symbols representing the fifty-two cards in a regular deck. The variable winning section changes into a big-winning state the predetermined number of times when the five symbols displayed on the five display positions form one of the winning combinations in the card game. During the big-winning state, a plurality of pachinko balls may drop at a time into the variable winning section. One big-winning state is completed when a predetermined time period lapses after the big-winning state starts, or when the number of pachinko balls having dropped into the variable winning section reaches a predetermined number.

U.S. Pat. No. 6,419,225 describes a slot-type gaming machine with variable drop zone symbols. A game machine includes a playing field traversed by objects, such as balls. The playing field can have plural drop zones which can be selected by the player using deflectors that control where the balls are launched. Detectors indicate scoring positions assumed by the balls. A payline display displays scored events. A symbol selector is included to select symbols which are variably assigned to the scoring positions and displayed on displays. Balls score symbols which can be displayed in the payline display and affect winning or bonus play. Game machine includes traditional slot machine reels which can work in conjunction therewith.

As one of the problems relating to the use of slot machines and the desirability of using more video components or purely video components is reduced maintenance due to physical wear, the use of mechanical pachinko components is less desirable. As the need to have separate balls traverse pathways is time consuming, it would be desirable to reduce the time of play institution and duration in pachinko style games.

It would be desirable to combine a slot-type video game with the ambiance of a pachinko-type game that overcomes at least some of the problems facing the using of pachinko-type games outside of the Pacific Rim markets.

SUMMARY OF THE INVENTION

A gaming system is provided in which a ball or virtual ball passes through a series of pachinko-style pegs or bumpers with symbol selection routes between the pegs or bumpers. There are multiple attached routes between pegs or bumpers so that the passage of a single ball along a path can provide multiple symbol selections. The selection of symbols is then implemented onto a reel type display that is used to determine winning events, pushing events or losing events according to conventional practice in slot-type machines. At least one of the reel displays or ball paths is a video display, and preferably both the reel display and the ball path display are video displays.

DETAILED DESCRIPTION OF THE INVENTION

Figure 1:
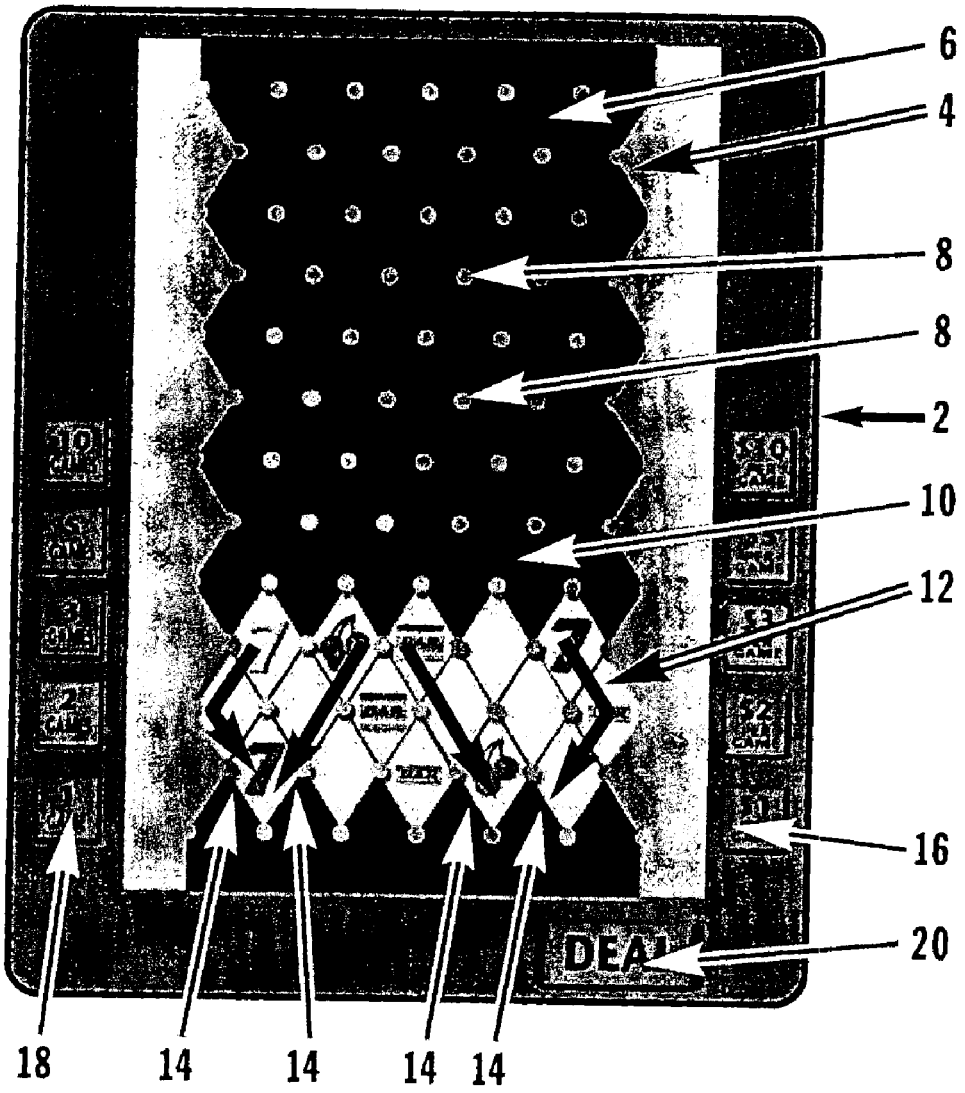
FIG. 1 shows a video screen with an image of a game format according to the present invention.

A gaming apparatus has a series of frames defined by pathways through the frames. The frames are defined by gates, pegs or other path edge separators. The pathway may be real pathways and the pegs or gates may be real pegs or gates (actual physical pegs) or the pathways, pegs and gates may be virtual images on a video monitor with electronic images displayed. The frames within the display have symbol displaying capability, either by having reels, electronic displays, or other image providing/symbol providing systems that can be readily changed between games. An indicator, such as a ball or virtual ball or virtual object is allowed to drop into a field of frames. As the object passes over frames, the symbols in the frames (including blank spaces) become active symbols in a video wagering game, by forming rows of symbols that are analyzed for winning combinations or by transferring the rows to a display that is more typical of a reel-type symbol display in rows and columns.

The processing technology used with the system may encompass unique hardware and software, PC-based hardware and software, MAC-based hardware and software, LINUX-based hardware and software, or any other processing system. Convention reel-mapping technologies or symbol-providing technologies may be used to provide the images and determine the frequency and size of awards in a random manner. Random number generators, random template selection, random individual frame image selection and the like may be used. The image may be provided by CRT, plasma screen, liquid crystal displays, or any other image providing format, especially digital imaging formats. The apparatus may operate with cash-in/cash-out technology, credit cards, currency and coin acceptors, ticket-in/ticket-out technology, smart card readers, house credit systems or the like. Internal and external security systems and authentication systems for software may be used in conjunction with the gaming apparatus, as is well understood by those skilled in the art.

The basic play of the game will be explained without reference to Figures, then the Figures will be introduced to further enable practice of the invention, and the play of the game will then be summarized.

The gaming apparatus provides symbols that are used to determine winning or losing outcomes. The symbols may provide such outcomes by the collective set of symbols, the order of symbols, or even by individual symbols or combinations of symbols, as is known in the gaming industry. For example, a scatter pay symbol in any position(s) can provide an award, four-of-a-kind in a poker hand in any order can provide an award, a Royal Flush in descending order A-K-Q-J-10 can provide a jackpot award, three bars of like or dislike appearance can provide an award in any order, three identical 7's can provide an award, a cherry in the first position can offer an award, etc. The order of symbols identified by an object-element can act the 'order' of the symbols, with those symbols being highlighted or transferred to a more readily readable format (e.g., reel display). An object-element (e.g., ball, projectile, animal, moving symbol, falling rock, pouring water, or any other graphic representation) passes in a path through displayed pathways on a display. The path may be defined by pegs (as in a pachinko machine), fences, boulders, pinball bumpers, bends in a river, passages through trees, rooms in a house, roads in a State, countries on a map, etc. As the object-element passes over symbol collecting positions on the display in the pathways, symbols on collecting positions are activated as part of a game display. By 'activating' a symbol it is meant that those symbols will be used in determining whether or not an award will be given in a particular game. It is desirable that some clear indication of 'activation' be given, such as a change in color, highlighting, animation, enlarging, or other visual change that can be observed by the player. The gaming apparatus provides at least one award for predetermined combinations of symbols or individual symbols, or orders of symbols, the object-element collecting or activating at least two symbols in a single pass through the path. This is in distinction to pachinko style games where individual balls identify single symbols by dropping into a slot or by passing through a single set of barriers or gate. The gaming apparatus can indicate an order from collection of the at least two symbols is indicated on the display. The number of symbols that can be collected in a pass can vary, as can the number of symbols that are used in determining winning or losing outcomes, just as with slot machines. A desirable number of symbols in a path comprises from 3 to 5 symbols. Multiple paths may be displayed, as with multiple rows of symbols in a 3 row by five column reel-type machine.

The pathway may move from one end of the display to an opposite end of the display, from top to bottom, left-to-right, right-to-left, bottom-to-top and corner-to-corner. The game may be a pure video gaming apparatus and the object-element, pathway and symbols are virtual displays, with no mechanical elements involved in moving the object-element, changing symbols and the like. Likewise, the gaming apparatus paths may be identified by virtual objects on the display, and the object-element may be an image of a ball, animal or projectile.

The gaming apparatus may give awards for predetermined symbols out of a total number of symbols provided by play of the game, and the object-element collects the total number of symbols in a single path to complete a game. All symbols on collecting positions may be displayed before the object-element enters any section of a pathway with a symbol on a collection position. That is, there may be as many as twenty levels of gates or path segments along the pathways between ends of the display, but only 2, 3, 4 or 5 (for example) of the levels may have symbols therein. Before the object-element actually enters the level where symbols are present and may be collected or activated, all symbols become fixed, so that the player can anticipate the possible outcome if the object-element passes through the best paths through the pathways.

These and other features of the invention will be understood by a review of the Figures.

FIG. 1 shows a video screen 2 with an image of a game format 4 according to the present invention. A background field 6 shown having an ordered array of pegs 8. There are spaces 10 between the pegs that define passages or paths. A clearly distinct set of frames 12 is on the field 6. This distinct set of frames 12 defines the symbol pathways (e.g., 14) that can be activated during play. In this particular-exemplary figure, there are three adjacent frames in each pathway 14 as in a three-reel display slot game. Player or user interface buttons 16 and 18 may be activated by the player. Touch screen activation may also be used. A deal button 20 is also shown.

Figure 2:
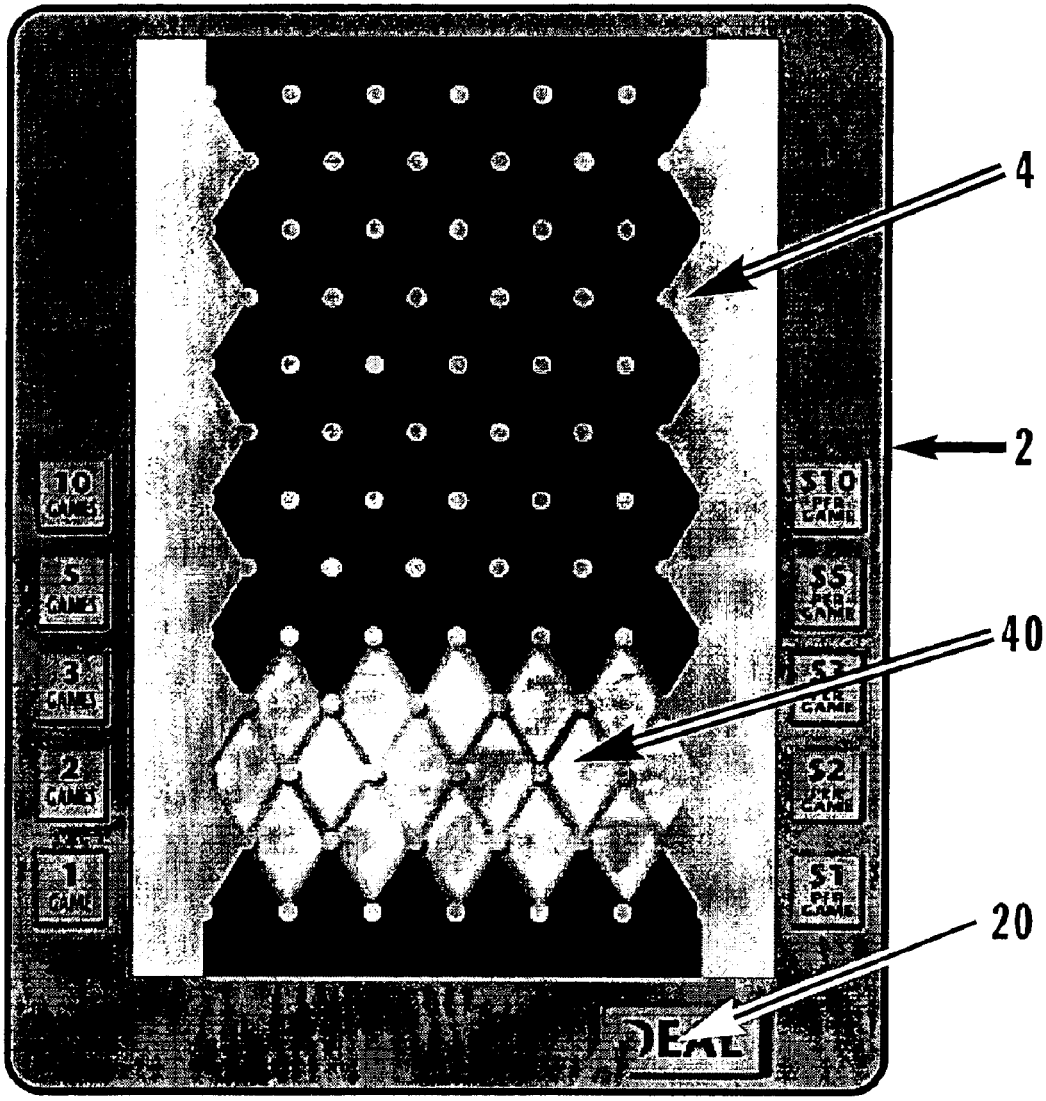
FIG. 2 shows a video screen with an image of a game format according to the present invention after initiation of a deal with symbol display positions spinning or otherwise selecting symbols.

FIG. 2 shows a video screen 2 with an image of a game format 4 according to the present invention after initiation of a deal with symbol display positions spinning or otherwise selecting symbols in distinct frames 40. The deal button 20 is shown being pressed.

Figure 3:
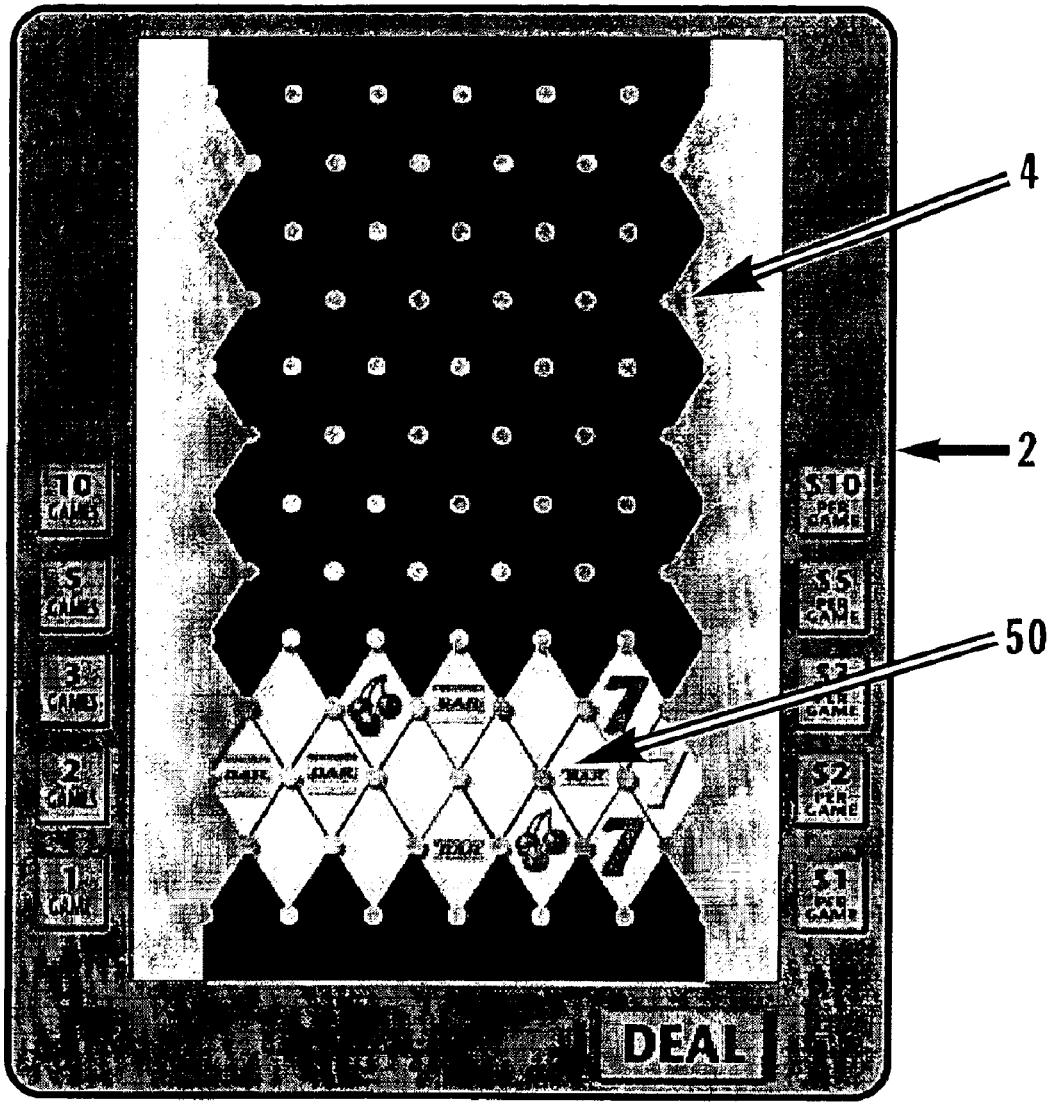
FIG. 3 shows a video screen with an image of a game format according to the present invention where symbols are displayed for play in a game.

FIG. 3 shows a video screen 2 with an image of a game format 4 according to the present invention where symbols (e.g., 50) are displayed for play in a game after the images have stopped moving as shown in FIG. 2.

Figure 4:
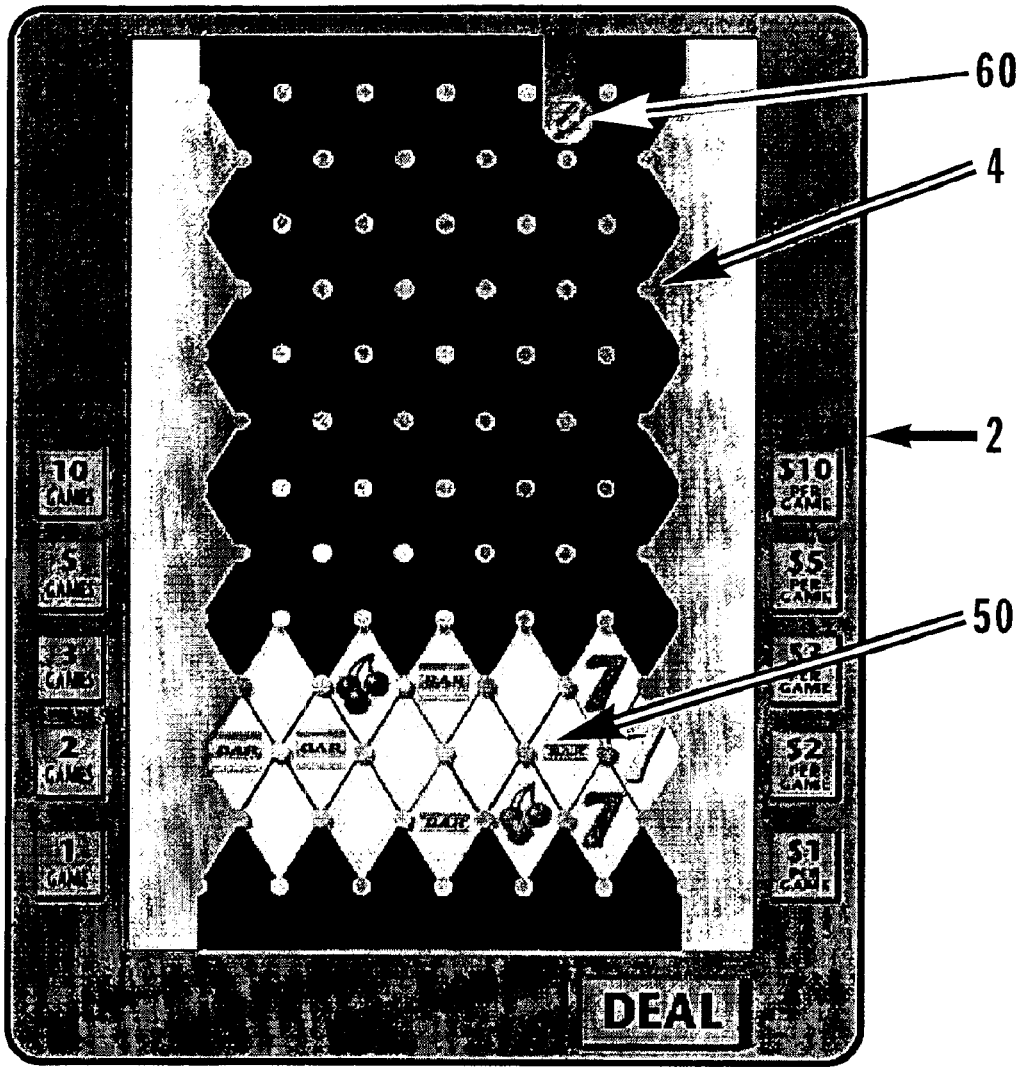
FIG. 4 shows a video screen with an image of a game format according to the present invention where a virtual ball has begun to drop towards the displayed symbols.

FIG. 4 shows a video screen 2 with an image of a game format 4 according to the present invention where a virtual ball 60 has begun to drop towards the displayed symbols 50.

Figure 5:
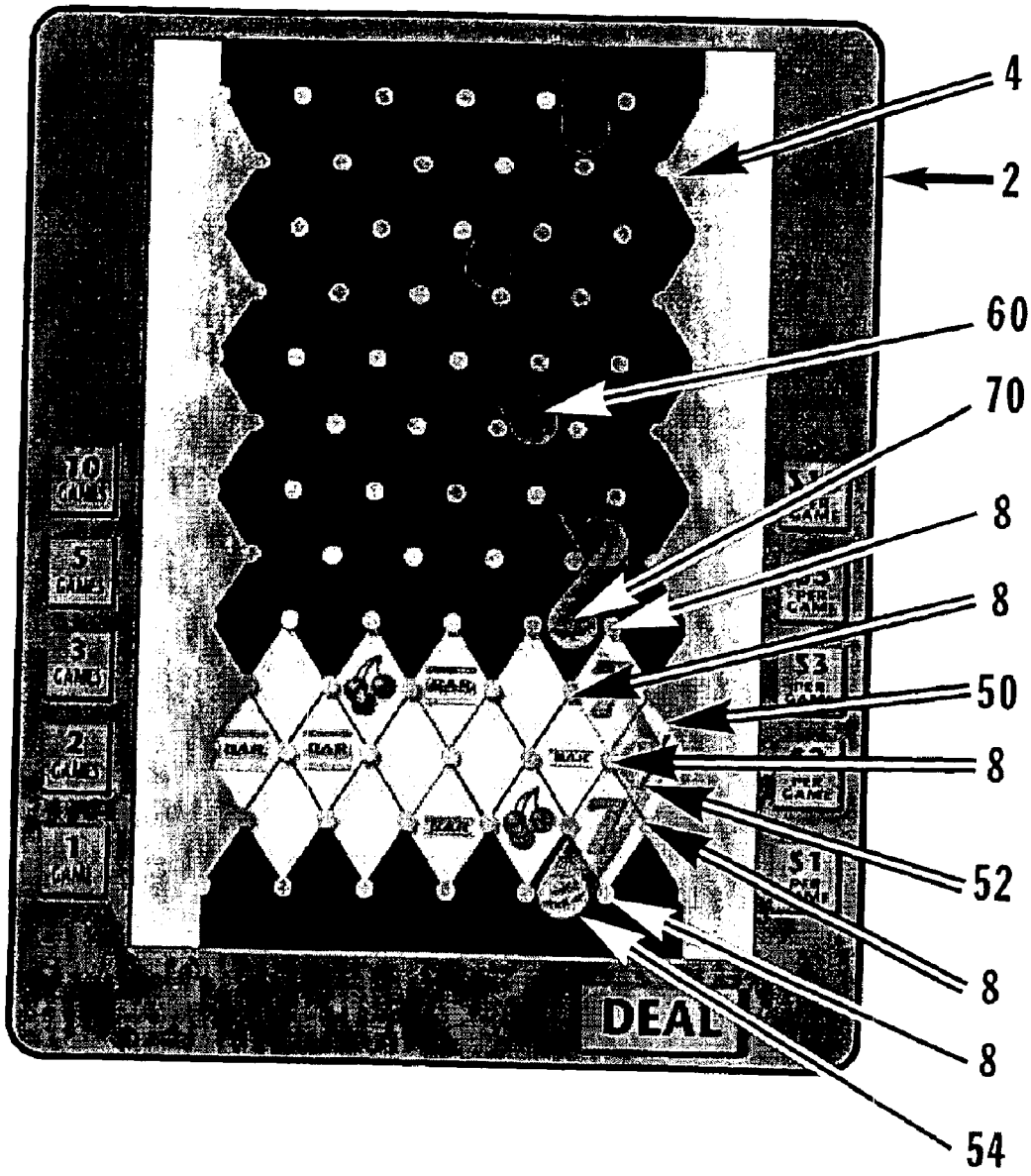
FIG. 5 shows a video screen with an image of a game format according to the present invention where a virtual ball has begun to drop towards the displayed symbols and a ball is about to enter a pathway between virtual pegs.

FIG. 5 shows a video screen 2 with an image of a game format 4 according to the present invention where a virtual ball 60 has begun to drop towards the displayed symbols 50 and the ball 70 is about to enter a pathway 52 between virtual pegs 8 and exit as ball 54.

Figure 6:
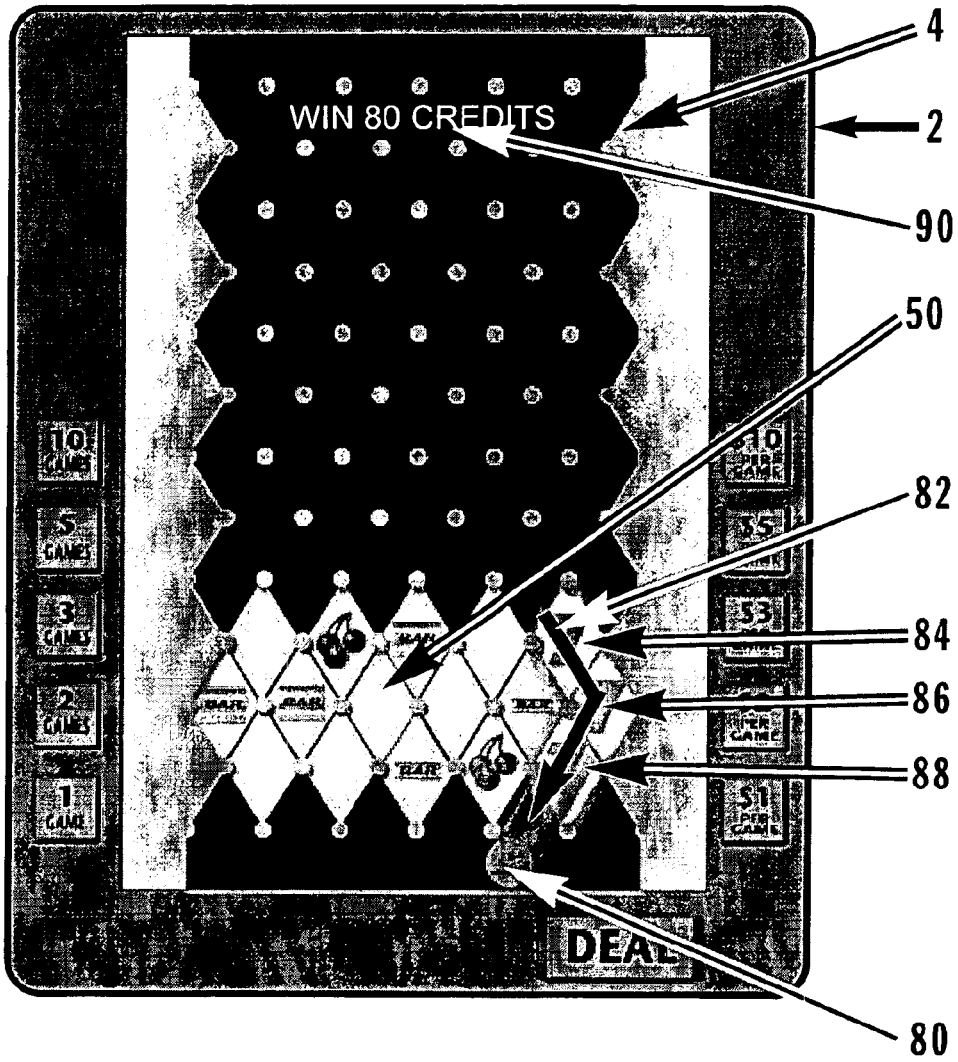
FIG. 6 shows a video screen with an image of a game format according to the present invention where a virtual ball has passed through a complete pathway to select three symbols that are highlighted to indicate the results of play.

FIG. 6 shows a video screen 2 with an image of a game format 4 according to the present invention where a virtual ball 80 has passed through a complete pathway 82 through the activatable collection of symbols 50 to select three symbols 84 86 88 that are highlighted to indicate the results of play. The system has a win display 90.

Figure 7:
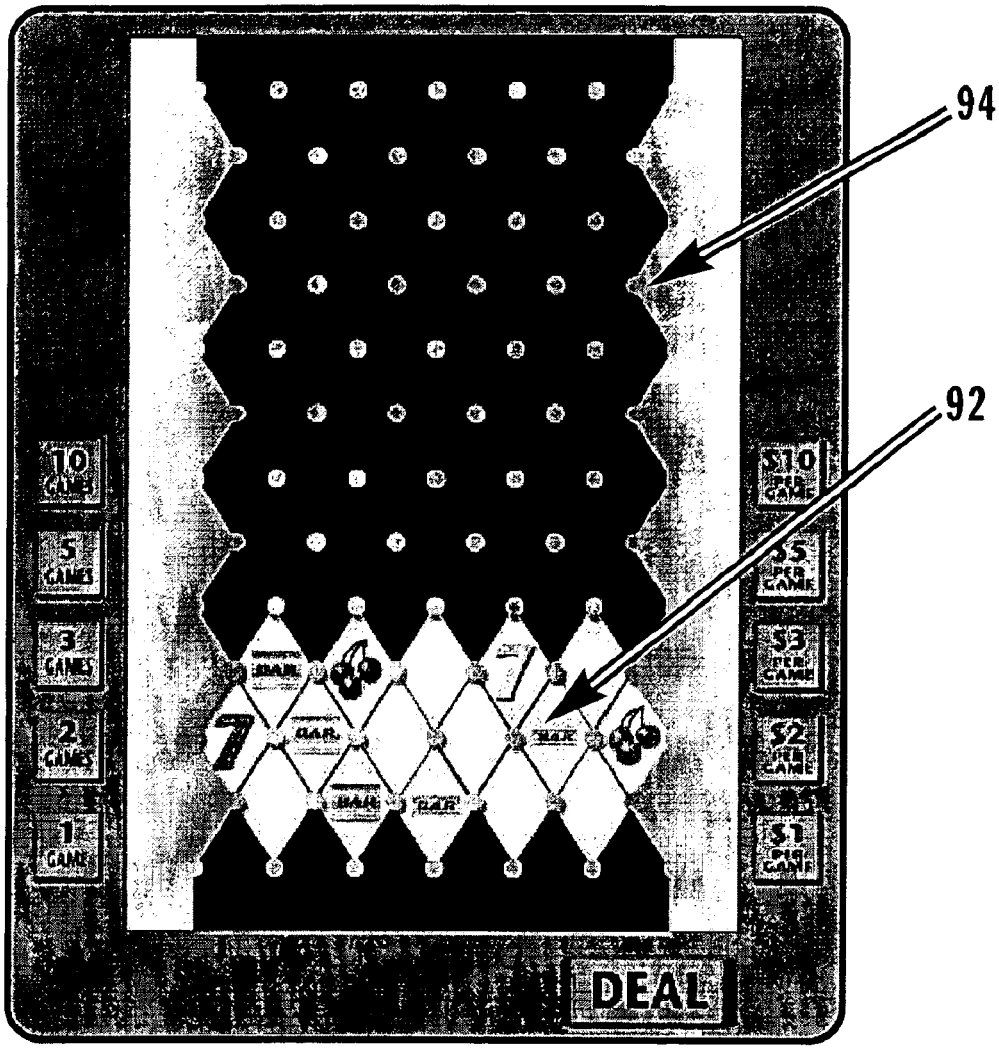
FIG. 7 shows a new arrangement of symbols on a screen of the present invention.

FIG. 7 shows a new arrangement of symbols 92 on a screen 94 of the present invention.

Figure 8:
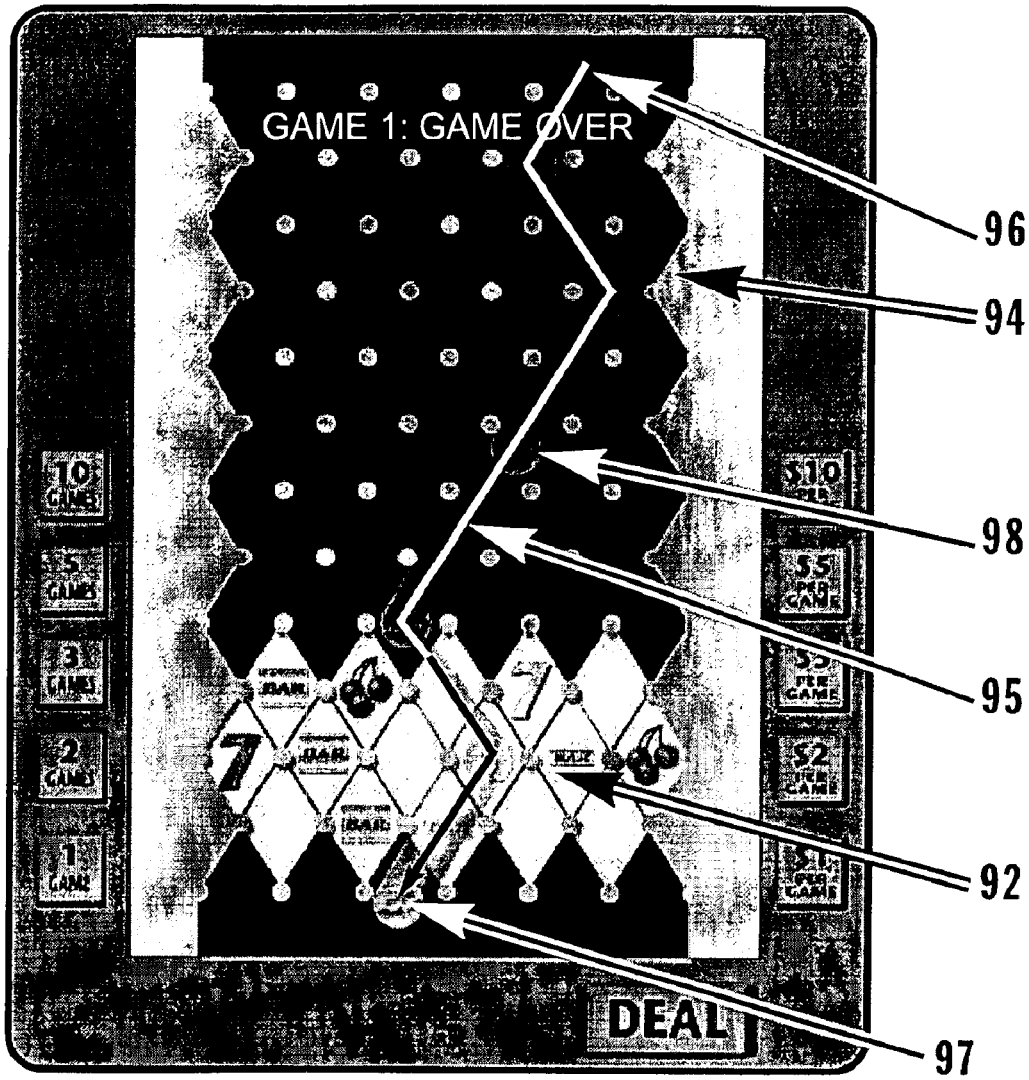
FIG. 8 shows the end of a first game on a screen of the present invention where more than one game is being played at a single wager.

FIG. 8 shows the end of a first game on a screen 94 of the present invention where more than one game is being played at a single wager. The complete path 95 of the ball 98 passing down the screen 94 and through the new set of symbols 92 is shown. The beginning of the path 96 to the end of the path 97 is shown.

Figure 9:
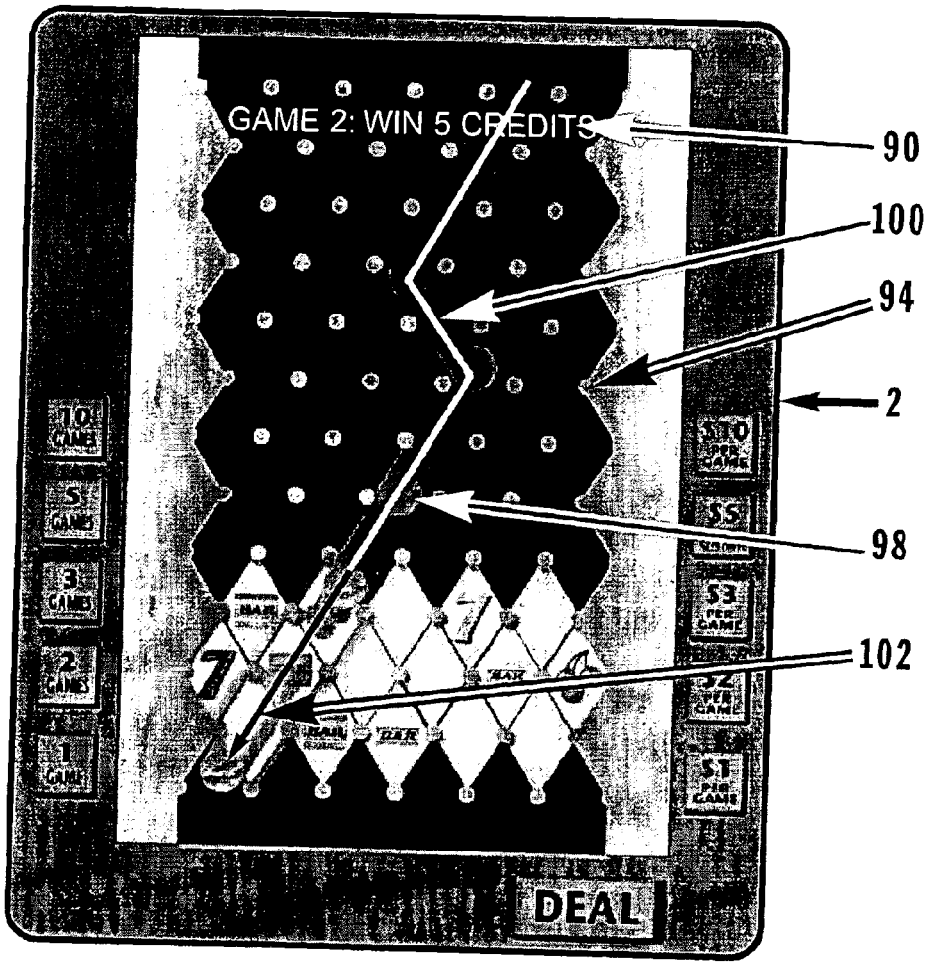
FIG. 9 shows a screen image of a second game played on the same screen as in FIGS. 7 and 8, with a different ball path shown.

FIG. 9 shows a screen image 2 of a second game played on the same screen 94 as in FIGS. 7 and 8, with the ball 98 moving along a different ball path 100 and 102 shown down the field and through the symbol activating area, respectively. The win results 90 are again shown.

Figure 10:
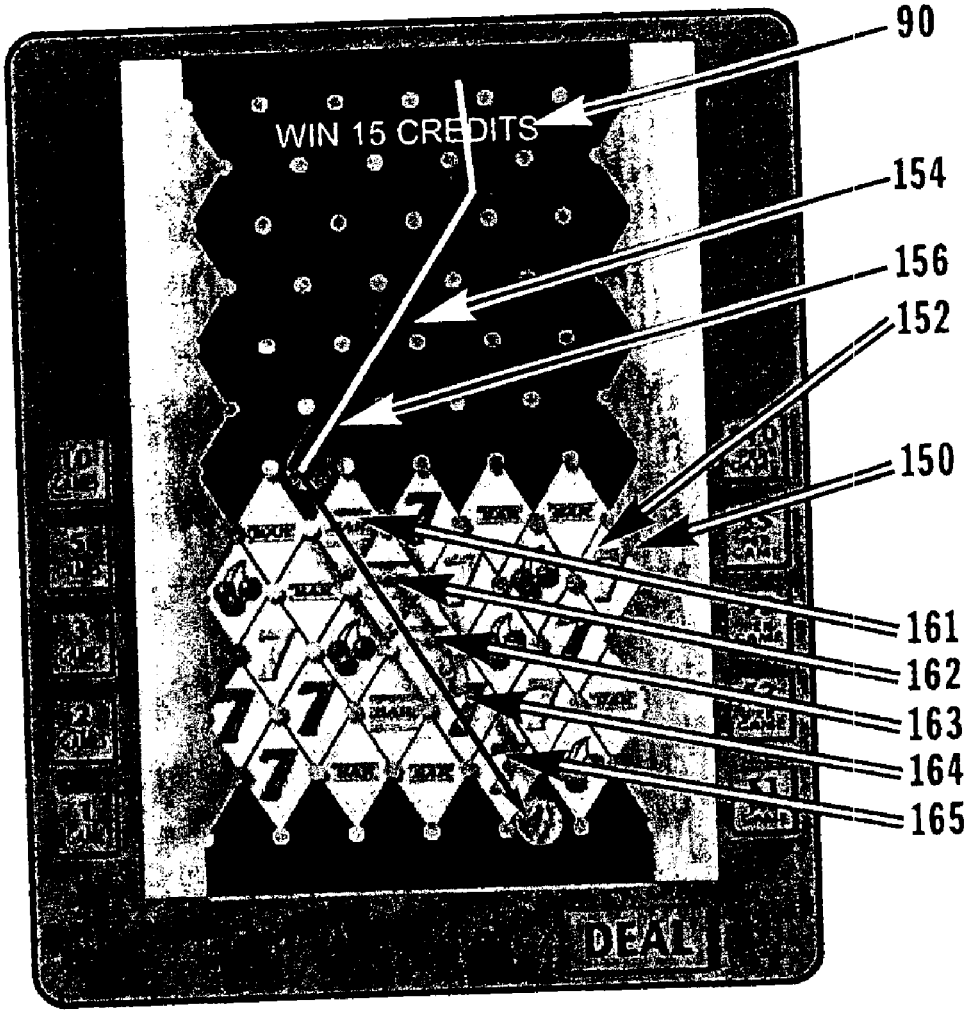
FIG. 10 shows an equivalent of a five column slot-type game with a virtual ball moving through five frames on the monitor.

FIG. 10 shows an equivalent of a five column slot-type game symbol array 152 with a virtual ball 154 passing down a complete path 156 and moving through five frames 161 162 163 164 165 on the monitor 150. The win results 90 are again shown.

Figure 11:
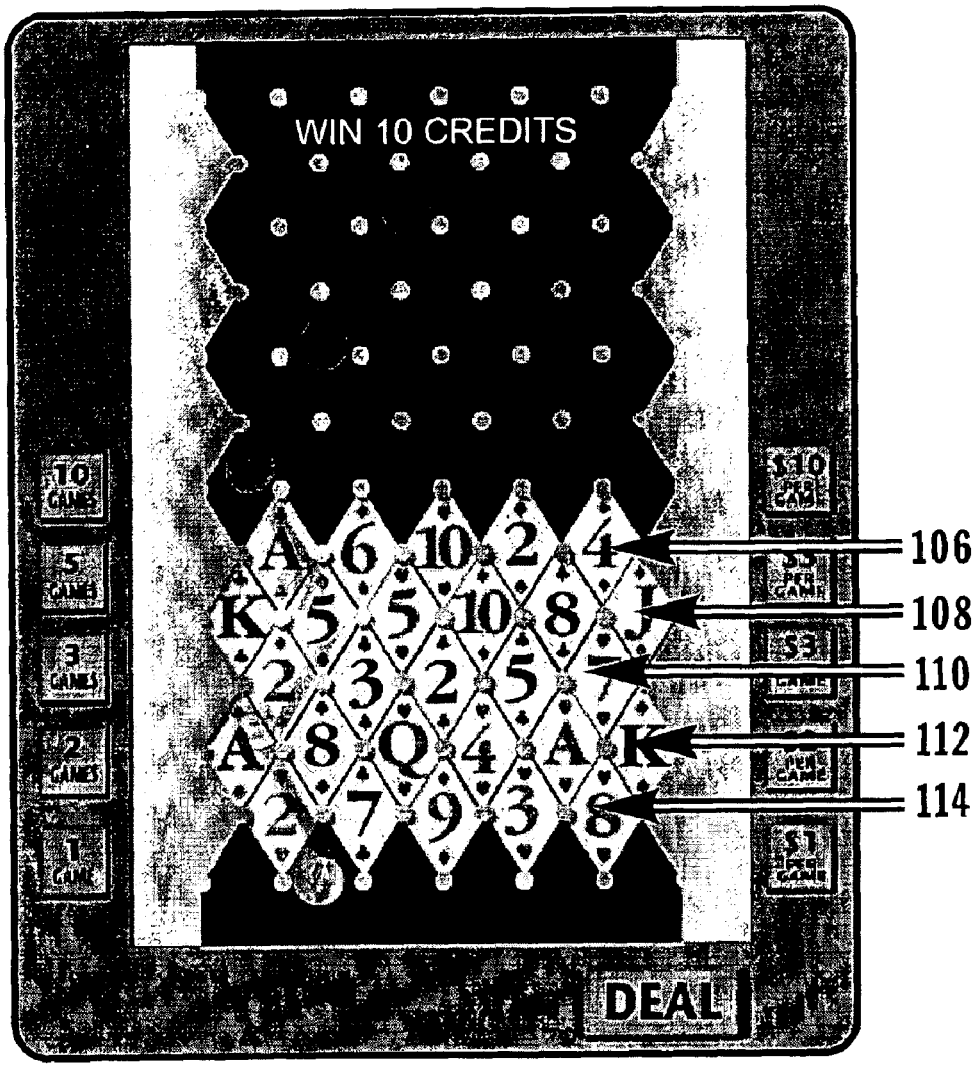
FIG. 11 shows an equivalent of a five column poker variant of a slot-type game with a virtual ball moving through five frames on the monitor.

FIG. 11 shows an equivalent of a five column poker variant of a slot-type game with a virtual ball moving through five frames on the monitor to provide two pair as a hand.

As can be seen, there are many variations in the practice of the invention. As with reel-type displays, blank symbols or blanks may be provided, wild cards may be present, 1, 2, 3, 4 or 5 symbols may be sufficient dependent upon position and/or order and rank to provide awards, any format of images may be used, object-element movement may be up, down, left, right, or combinations of these directions. Even a circular pathway may be used where a ball is launched and there are many gates, and the ball becomes active after a random number of gates passages or (e.g., when a fuse on a bomb display burns down, a candle burns down, petals fall from a flower, or some other time measurable or distance measured event occurs).

Although a preferred display format is to have symbol activateable areas immediately adjacent to each other so that potential large awards can be easily viewed and therefore anticipated, there may be spacing between levels of awards. For example, in FIG. 11, levels 106, 108, 110, 112 and 114 may be separated rather then forming a continuous path.

Other alternatives and equivalents are apparent to those skilled in the art as within the scope of the present invention and the claimed invention.

What is claimed:

1. A gaming apparatus in which symbols are provided within multiple attached routes through a series of pachinko-style pegs so that an object element passes through a single route from among the multiple attached routes through the pachinko-style pegs to determine winning outcomes, wherein the object-element passes in a path through displayed pathways on a display, as the object-element passes over symbol collecting positions on the display in the pathways, symbols on collecting positions are activated as part of a game display, the gaming apparatus providing at least one award for predetermined combinations of symbols, the object-element collecting at least two symbols in a single pass through the path.

2. The gaming apparatus of claim 1 wherein an order for collection of the at least two symbols is indicated on the display and the object element drops down from top to bottom through the single path wherein the symbols are both displayed and provided within the multiple attached routes.

3. The gaming apparatus of claim 1 wherein the at least two symbols comprises from 3 to 5 symbols.

4. The gaming apparatus of claim 1 wherein the at least two symbols comprises from 3 to 5 symbols and an order for collection of the 3 to 5 symbols is indicated on the display, wherein the symbols are both displayed and provided within the multiple attached routes.

5. The gaming apparatus of claim 4 wherein the game is a video gaming apparatus and the object-element, pathway and symbols are virtual displays.

6. The gaming apparatus of claim 5 wherein paths are identified by virtual objects on the display.

7. The gaming apparatus of claim 6 wherein the object is an image of a ball, animal or projectile.

8. The gaming apparatus of claim 6 wherein all symbols on collecting positions are displayed before the object-element enters any section of a pathway with a symbol on a collection position.

9. The gaming apparatus of claim 5 wherein awards are given for predetermined symbols provided by play of the game, and the object-element collects a total number of symbols in a single path to complete a game.

10. The gaming apparatus of claim 1 wherein the pathway moves down from one top end of the display to an opposite bottom end of the display.

11. The gaming apparatus of claim 10 wherein the game is a video gaming apparatus and the object-element, pathway and symbols are virtual displays.

12. The gaming apparatus of claim 11 wherein paths are identified by virtual objects on the display.

13. The gaming apparatus of claim 12 wherein the object is an image of a ball, animal or projectile.

14. The gaming apparatus of claim 11 wherein awards are given for predetermined symbols provided by play of the game, and the object-element collects a total number of symbols in a single path to complete a game.

15. The gaming apparatus of claim 1 wherein the pathway moves between the top and bottom of the display, collecting symbols that are then displayed in a displayed collection area.

16. The gaming apparatus of claim 15 wherein the game is a video gaming apparatus and the object-element, pathway and symbols are virtual displays.

17. The gaming apparatus of claim 16 wherein awards are given for predetermined symbols provided by play of the game, and the object-element collects a total number of symbols in a single path to complete a game.

18. The gaming apparatus of claim 16 wherein all symbols on collecting positions are displayed before the object-element enters any section of a pathway with a symbol on a collection position.

19. The gaming apparatus of claim 1 wherein the game is a video gaming apparatus and the object-element, pathway and symbols are virtual displays.

20. The gaming apparatus of claim 19 wherein paths are identified by virtual objects on the display.

21. The gaming apparatus of claim 20 wherein the object is an image of a ball, animal or projectile.

22. The gaming apparatus of claim 20 wherein all symbols on collecting positions are displayed before the object-element enters any section of a pathway with a symbol on a collection position.

23. The gaming apparatus of claim 19 wherein awards are given for predetermined symbols provided by play of the game, and the object-element collects a total number of symbols in a single path to complete a game.

24. The gaming apparatus of claim 19 wherein all symbols on collecting positions are displayed before the object-element enters any section of a pathway with a symbol on a collection position.

25. A video gaming apparatus in which where winning is determined by a collective set of symbols, and symbols to be collected are displayed and provided within attached routes through a series of paths limited by objects in a displayed video image so that an object element passes in a single direction selected from the group consisting of downward, upward, left-to-right, and right to left through a single route from among the multiple attached routes through the paths to determine winning outcomes, wherein the object-element passes in a path through displayed pathways on a display, as the object-element passes over symbol collecting positions on the display in the pathways, symbols on collecting positions are activated as part of a game display, the gaming apparatus providing at least one award for predetermined combinations of symbols, the object-element collecting at least two symbols in a single pass through the path, the at least two symbols comprising the collective set of symbols in a reel-type display.

* * * * *